United States Patent [19]

Finkl

[11] Patent Number: 4,887,277

[45] Date of Patent: Dec. 12, 1989

[54] ELECTRIC ARC FURNACE

[75] Inventor: Charles W. Finkl, Evanston, Ill.

[73] Assignee: A. Finkl & Sons Co., Chicago, Ill.

[21] Appl. No.: 247,838

[22] Filed: Sep. 22, 1988

[51] Int. Cl.[4] ..... F27D 1/00; F27B 14/00

[52] U.S. Cl. ..... 373/71; 373/72; 373/75

[58] Field of Search ..... 373/71, 72, 74, 84; 266/275

[56] References Cited

U.S. PATENT DOCUMENTS 1,385,411 7/1921 Vom Baur ..... 373/72

1,553,618 9/1925 Kay ..... 373/84

3,400,208 9/1968 Franzen ..... 373/75

*Primary Examiner*—Roy N. Envall, Jr.

*Attorney, Agent, or Firm*—James G. Staples

[57] ABSTRACT

An improved electric arc furnace provides increased capacity and reduced operating costs. The furnace has an ob-round shape which locates sidewalls further from the source of heat. The improved furnace can accept a larger scrap charge and provides a larger surface area for slag reactions to take place. All of these advantages are obtained without the need for building new foundations or ancillary equipment.

8 Claims, 1 Drawing Sheet

ELECTRIC ARC FURNACE

BACKGROUND AND SUMMARY OF THE INVENTION

This invention relates to electric arc furnaces, which are used to make molten metal from which batches of steel can be made. In particular, this invention relates to an improved vessel having an oval or ob-round shape which prolongs the life of the refractory linings of such furnaces, decreases back charging and facilitates chemical reactions in the furnace as compared to a conventional vessel which processes a similar charge.

U.S. Pat. No. 3,400,208, which is assigned to the assignee of the present invention, shows an electric arc furnace which is circular in horizontal cross-section, and which includes a frusto-conical section. Furnaces made in accordance with U.S. Pat. No. 3,400,208, are generally referred to as tapered arc furnaces, and such furnaces have proven to be very effective in process of making steel. Because the present invention is an improvement over tapered arc furnaces, U.S. Pat. No. 3,400,208 is incorporated herein by reference.

Increased costs, such as energy, labor and refractory costs, have given rise to a need for increased capacity of electric arc furnaces.

Accordingly, a primary object is to provide an electric arc furnace in which the refractory costs and frequency of relining are reduced.

Yet another object of the invention is to provide an oval electric arc furnace of increased tonnage which is usable in conjunction with existing foundations.

Still another object is to decrease the time required to melt and refine a given quantity of steel in the furnace.

Yet another object is to provide an electric arc furnace as above described which can be operated with existing ancillary equipment.

Yet another object of the invention is to provide an electric arc furnace as above described which can be constructed from existing circular tapered arc furnaces at a minimum cost.

Yet another object of the invention is to provide an electric arc furnace which has increased volume, but which requires substantially no increase in energy input to prepare a melt of a given weight of steel.

Yet another object of this invention is to provide a simple and economical method of increasing the batch size of existing arc furnaces.

Yet a further object of this invention is to provide a simple and economical method of increasing the batch size of existing tapered arc furnaces.

These and other objects of the invention will become apparent upon reading the following description read with reference to the following drawings

DETAILED DESCRIPTION OF THE INVENTION

The furnace will first be described using, as a reference, a conventional furnace having a metal charge of equal weight.

Figure 1:
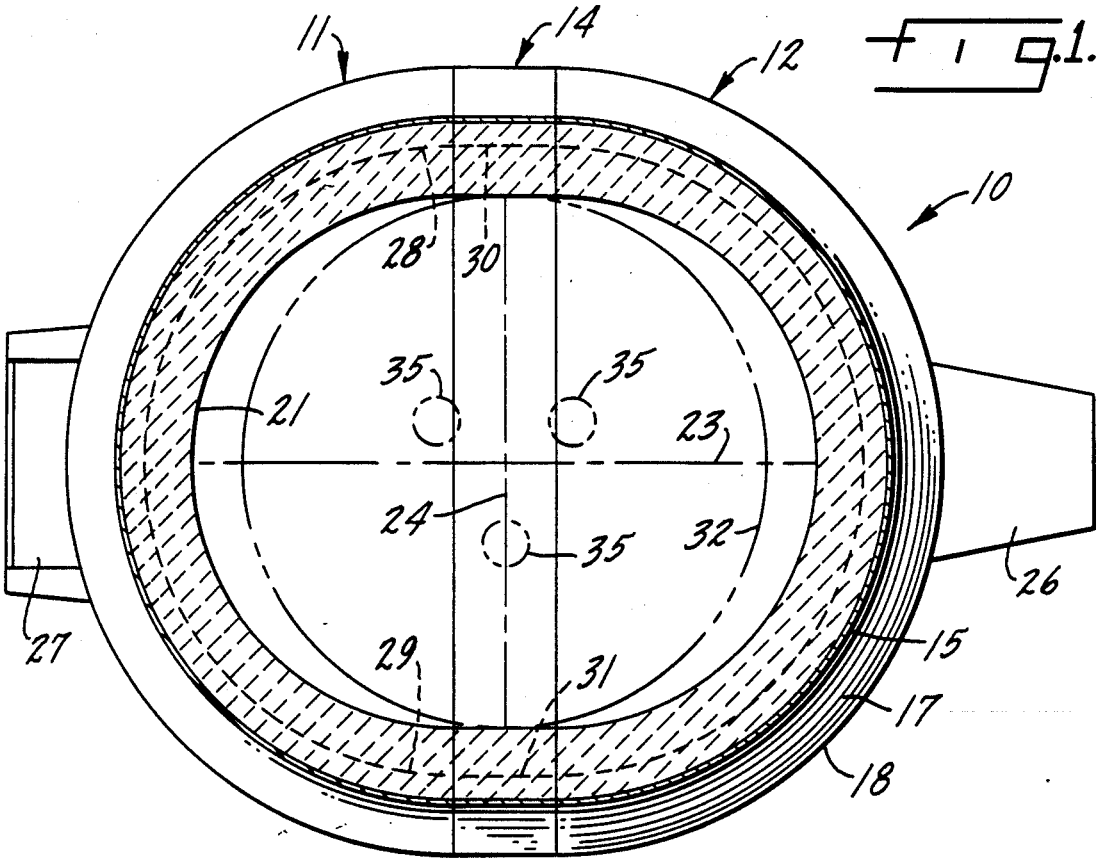
FIG. 1 is a section view of the electric arc furnace of the invention taken along line 1—1 of FIG. 2.

FIG. 1 shows an embodiment of the invention in which a vessel 10 is shown in horizontal cross-section. Two generally circular sections 11 and 12 are separated by an enlargement section 14. As a result, horizontal cross-sections through the upper part 15, the tapered portion 17, the vertical wall section or sill level area 18, the dished bottom 20, as well as the top opening 21 all have an ob-round shape in a plan view. The term "ob-round" as used in this specification is meant to describe a shape having substantially rounded ends joined by straight side elements.

The ob-round shape of the vessel shown in FIG. 1 defines a major axis 23, and a minor axis 24, with the minor axis being shorter than the major axis. A spout 26 and a charging door 27 are disposed on opposite sides of the vessel 10 along the major axis 23. A mast wall 28 and the opposite wall 29 each have flat sections 30 and 31.

The dotted line 32 shows the circular shape of prior art tapered arc furnaces. As will be discussed below with reference to FIG. 2, the portions of the circular or hemispherical sections 11 and 12 which are near the spout 26 and the charging door 27 are located farther from the center of the vessel than are the sidewalls which lie along the minor axis 24. This has particular advantage because the life of the refractory is proportional to the square of the distance from the source of heat in the furnace. Since the walls which are adjacent to the spout 26 and charging door 27 are spaced further from the center of the furnace than are the spout and charging door in a conventional furnace, the degrading effect of the heat emanating from the electrodes will be far less in the furnace of the present invention as contrasted to the conventional prior art furnace. However, by keeping the walls which lie along the minor axis 24 at a distance which corresponds to existing foundations, ancillary equipment, such as rockers (not shown), trunion supports, and tilting equipment (not shown), associated with existing arc furnaces, can be used without modification.

Figure 2:
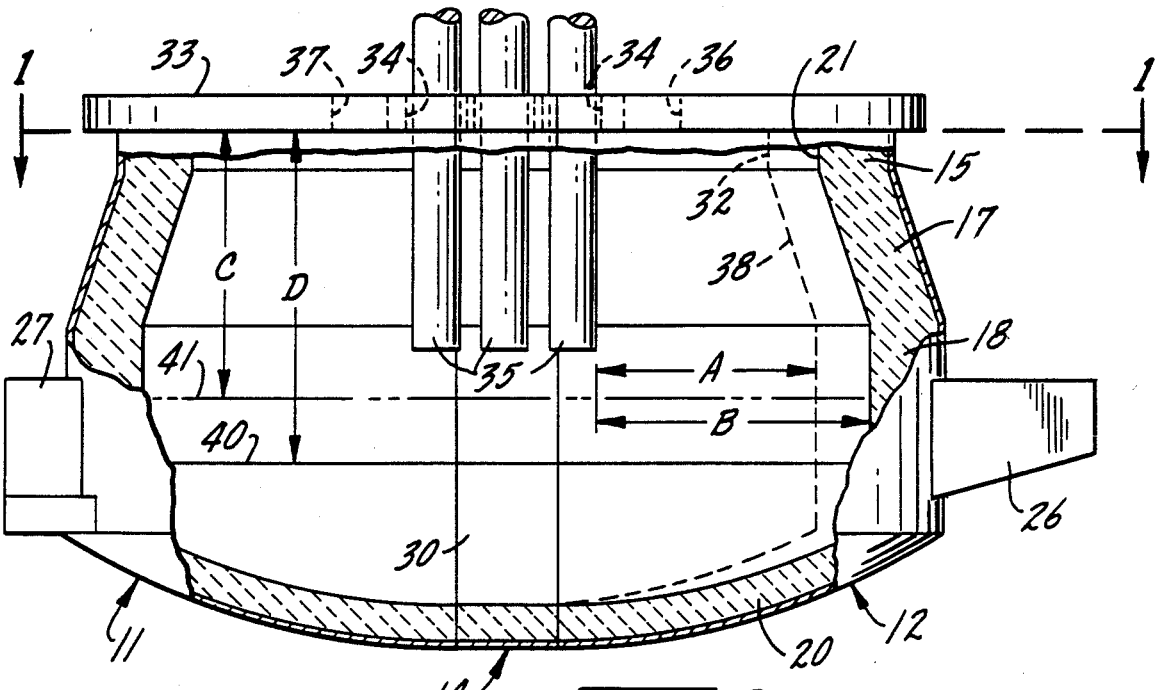
FIG. 2 is a side-elevation, in partial section, of the electric arc furnace made in accordance with the invention.

FIG. 2 is a side-elevation view which shows the vessel 10 in partial section. The vessel 10 is shown with a roof 33 which includes openings 34 through which electrodes 35 extend. A pair of rockers (not shown) is attached to the side of the vessel 10. As the electrodes 35 are lowered into the vessel 10, charge material (not shown in solid form) begins to melt. Three electrodes are shown in FIG. 1, and such an arrangement would be usable with an A.C. three phase power source. However, a single electrode D.C. system could also be used and would reduce the number of openings in the roof. In addition to the openings 34, the roof 33 has fourth and fifth openings 36 and 37, respectively, which are used to add alloys to the melt and to extract material from the furnace. After the charge material is melted, the vessel is tilted on rockers so that the melted charge taps through the spout 26. The vessel tilts about a tilt axis which is perpendicular to the major axis. The vessel 10 has been enlarged along the major axis, and the spout 26 has been shortened as compared to conventional furnaces. By shortening the spout by an amount approximately equal to one-half of the length of the enlargement section 14, the location of the tap, i.e. where the melt falls, can remain the same as with conventional furnaces. An advantage of using a shortened spout is that less deleterious gas (nitrogen, oxygen and hydrogen) is entrapped in steel made with the furnace, because when a shorter spout is used there is less exposure to atmosphere containing such gases.

The unique configuration of the vessel of the present invention has several advantages. Some of those advantages relate to the fact that the life of refractory material is proportional to the square of the distance of that material from a heat source. The enlarged volume of the vessel 10 means that a given amount of charge material, when melted, will have a top surface 40 which is farther from the roof 33, as indicated by the distance D, as contrasted to distance C, which is the distance between the top surface 41 of the metal and the roof in a conventional furnace. Similarly, the sidewalls, particularly at the front and rear of the furnace, will degrade at a slower rate.

Alternatively, if increased capacity is desired, larger amounts of charge material can be placed in the furnace. If this option is chosen refractory life of the roof 33 would be approximately the same as with prior furnaces. However, sidewall refractory life would be improved, because of the increased distance of the sidewalls from the electrodes.

Another benefit of constructing a furnace in accordance with the present invention is related to the enlargement of the surface area of melted charge and slag material, again in the context of a comparison of heats of the same weight in this invention and in conventional furnaces. As charge material is melted, the components of the melted charge tend to combine and react with the lag at an interface within the melt. By increasing the cross-sectional area of the vessel, the interface area is similarly increased. The increased interface area allows for quicker chemical reactions.

A further advantage of the present invention is the ability to increase the initial scrap charge and, consequently, decrease the number of back charges, thereby significantly decreasing the heat time. By use of the ob-round vessel shown in this invention, an operator is able to charge the furnace with a larger quantity of scrap; indeed, the elimination of a back charge becomes a possibility.

In a particular example of the present invention, as shown in FIG. 2, the dotted line 38 shows the shape of a prior art furnace. Distance A represents the distance from the closest electrode to the sidewall in the pouring spout area. Distance B shows the increased distance of the sidewall from the electrode in the pouring spout area of this invention. The addition, for example, of a 24 inch enlargement section 14 increases the sidewall-to-electrode distance in these areas from 56 to 68 inches. Theoretically, this results in an increase of 47% in the life of the refractory material in the sidewalls at the locations of the spout and charging door. Similarly, a horizontal cross-sectional area through the vertical wall section 18 of a furnace as modified in this example would have an area which is increased by nearly 20%. Therefore, as shown in this example, the addition of enlargement section 14 results in substantial savings in refractory costs and chemical reaction time. Also, the volume of the furnace is increased by approximately 20% which enables the use of substantially more bulky scrap, or larger heat size.

All of the above advantages can be obtained without incurring the expense of creating new foundations, without purchasing new ancillary equipment, and without resorting to increased energy input or larger sources of power.

While the present invention has been described with reference to a specific embodiment, it is intended that the scope of the invention be limited not by the specific, illustrated construction, but rather by the scope of the appended claims when interpreted in light of the pertinent prior art. Furthermore, it is anticipated that many variations, modifications, and alternatives to the above described embodiment may be made without departing from the spirit and scope of the invention.

I claim:

1. In an electric arc furnace of the type in which charge material is subjected to an arc under substantially atmospheric conditions and having a shell which includes a dished bottom and having upwardly extending side walls which define a major, lengthwise axis and a minor tilt axis about which said shell is adapted to be rotated, and means to facilitate rotation of said shell about said tilt axis, the improvement comprising the shell having an ob-round shape derived from steel enlargement means for increasing capacity of said furnace, said enlargement means comprising an intermediate wall section disposed midway between opposed hemispheres of said shell, the opposing faces of said intermediate wall section being located in substantially parallel relationship to one another and to the major axis.

2. An electric arc furnace in accordance with claim 1 wherein:

said opposite sides are circular in horizontal cross-section, said shell having a mast wall and an opposite corresponding wall, each having flat portions.

3. An electric arc furnace in accordance with claim 1 wherein:

said sections are dimensioned such that capacity of said furnace is increased by at least about 20% without displacement of the tilt axis.

4. An electric arc furnace comprising a vessel and roof, said vessel having an ob-round shape in horizontal cross-section, said shape having a major axis and minor axis, said vessel being longer in a direction parallel to said major axis than in a direction parallel to said minor axis, the increased length in said major axis direction being derived from an intermediate section in which the opposing faces of the intermediate wall section are located parallel to one another an to the major axis, said vessel having a spout in alignment with said major axis, said vessel having a charging door opposite said spout.

5. An electric arc furnace in accordance with claim 1 wherein:

said vessel has an upwardly inward tapering portion and a dished bottom with a vertical area therebetween.

6. An electric arc furnace in accordance with claim 5 wherein:

said roof has at least one opening therethrough for allowing insertion of at least one electrode into said vessel.

7. An electric arc furnace in accordance with claim 4 wherein:

said spout is shortened so as to entrap less deleterious gas in steel made with said furnace while maintaining the same centerline-to-spout dimension as with a round furnace.

8. A method of increasing capacity of a tapered shell electric furnace having a substantially circular shape in horizontal cross-section and having means attached thereto for facilitating rotation thereof about a tilt axis, said method including the steps of:

dividing said furnace into two generally equal portions by making a vertical cut through said furnace, said cut being generally parallel to said tilt axis, placing at least one enlargement section between said portions generally perpendicular to said tilt axis;

joining said enlargement section to each of said portions, whereby supports for said furnace usual before increasing said capacity are usable after increasing said capacity without modification.

* * * * *